US007201222B2

(12) United States Patent
Kanady et al.

(10) Patent No.: US 7,201,222 B2
(45) Date of Patent: Apr. 10, 2007

(54) METHOD AND APPARATUS FOR ALIGNING ROTOR IN STATOR OF A ROD DRIVEN WELL PUMP

(75) Inventors: Edward C. Kanady, Tulsa, OK (US); Bruce E. Proctor, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 295 days.

(21) Appl. No.: 10/855,273

(22) Filed: May 27, 2004

(65) Prior Publication Data

US 2005/0263289 A1 Dec. 1, 2005

(51) Int. Cl.
*E21B 43/00* (2006.01)

(52) U.S. Cl. ..... 166/68; 166/105; 417/360; 418/48

(58) Field of Classification Search ..... 166/68, 166/369, 105, 69, 107; 417/360; 418/48
See application file for complete search history.

(56) References Cited

U.S. PATENT DOCUMENTS 4,592,427 A * 6/1986 Morgan ..... 166/369
5,209,294 A 5/1993 Weber
5,220,829 A * 6/1993 Manke et al. ..... 73/152.18
5,725,053 A * 3/1998 Weber ..... 166/105
6,338,388 B1 1/2002 Winkler
6,358,027 B1 3/2002 Lane
6,457,958 B1 10/2002 Dunn
6,729,391 B2 * 5/2004 Hill et al. ..... 166/68.5
2003/0111221 A1 6/2003 Hill et al.

FOREIGN PATENT DOCUMENTS

EP 0854266 A 7/1998

OTHER PUBLICATIONS

World Oil, Apr. 2004, *What's New in Artificial Lift*, pp. 61, 66, 68 and an additional page.

* cited by examiner

*Primary Examiner*—Kenneth Thompson
(74) *Attorney, Agent, or Firm*—Bracewell & Giuliani LLP

(57) ABSTRACT

A progressing cavity rod-driven well pump utilizes a tag shoulder above a helical passage of the stator. The pump stator is located at the lower end of a string of tubing. The tag shoulder is more restrictive than a passage through the tubing. A pump rotor is secured to a string of rods and has a stop located above the rotor. The rotor is lowered on the rods until the stop lands on the tag shoulder. Then the operator lifts the rods and the rotor to accommodate for expected stretch during operation. By removing the rods and rotor, monitoring tools can be lowered through the tag shoulder and stator.

17 Claims, 2 Drawing Sheets

METHOD AND APPARATUS FOR ALIGNING ROTOR IN STATOR OF A ROD DRIVEN WELL PUMP

FIELD OF THE INVENTION

This invention relates in general to progressing cavity rod driven well pumps that are driven by a motor at the surface, and particularly to a method and apparatus for axially spacing the rotor within the stator.

BACKGROUND OF THE INVENTION

A progressing cavity pump has a stator and a rotor. The stator typically comprises an elastomeric liner within a housing. The stator is open at both ends and has a double helical passage extending through it. The rotor is normally of metal and has a single helical exterior formed on it. Rotating the rotor causes fluid to pump through the stator. Progressing cavity pumps are used for a variety of purposes.

As a well pump, progressing cavity pumps may be driven by a downhole electrical motor or by a string of rods extending to a motor located at the surface. With a rod driven pump, normally the stator is suspended on a string of tubing, and the drive rods are located within the tubing. When installing a rod driven progressing cavity pump, the operator first secures the stator to the string of tubing and runs the tubing into the well to a desired depth. The operator then lowers the rotor through the tubing on the string of rods and into the stator.

To operate the pump at desired capacity, the rotor must be at the desired axial spacing within the stator and the rods must be in tension. If the lower end of the rotor is spaced above a lower end of the stator during operation, then a lower portion of the stator will not be in engagement with the rotor and the pumping capacity will suffer. The operator thus needs to know when the rotor has fully entered the stator during installation. The operator can calculate how much the rods will stretch due to the hydrostatic weight of the column of well fluid in the tubing. With the anticipated stretch distance known and with the rotor at a known initial position in the stator, the operator can pull the rods and rotor upward a distance slightly greater than the anticipated stretch, so that during operation, the rotor will move back downward to the desired axial position relative to the stator.

In the prior art, prior to running the tubing, the operator secures or welds a tag bar across the bottom of the stator. During installation, downward movement of the rods will stop when the lower end of the rotor contacts the tag bar at the bottom of the stator. Upon tagging the bar, the operator pulls the rod string back toward the surface by the calculated amount of rod stretch. During operation, as well fluid fills the tubing, the rod stretches, allowing the rotor to move back downward until in full engagement with the stator. If installed properly, once the rods have stretched fully, the lower end of the rotor will be spaced above the tag bar and the rods will be in tension.

While this method works well enough, tag bar creates an obstruction at the bottom of the pump. The obstruction prevents the operator from lowering tooling or instruments through and below the pump for logging, tagging fill, and other monitoring related purposes.

SUMMARY OF THE INVENTION

In this invention, a tag shoulder is positioned above the stator. The tag shoulder defines a restrictive passage to the stator that is more restrictive than the passage through the tubing to the shoulder. The operator installs a stop above the rotor. The stop will freely pass through the tubing, but will not pass through the tag shoulder.

The operator lowers the rotor on the string of rods until the stop lands on the tag shoulder. At this point, the lower end of the rotor will be spaced below the lower end of the stator. The operator then lifts the string of rods and the rotor a selected distance that places the stop above the shoulder. This distance is calculated to be slightly more than the expected stretch of the rods due to the weight of a full column of liquid in the tubing. At this distance, the lower end of the rotor will be above the lower end of the stator.

Once the rods start rotating and the pump begins to lift liquid to the surface, the rods will stretch. When the tubing is completely full, the rotor will have moved downward to fully engage the stator. The lower end of the rotor will be substantially flush with the lower end of the stator, however, the stop will still be located above the shoulder. The rotor orbits within the stator during operation. The stop is dimensioned so that it will orbit also without contact with the tag shoulder.

The operator can retrieve the rods and the rotor, then run tools or instruments in on wireline for monitoring purposes. The tools are dimensioned to pass through the tag shoulder and inner diameter of the stator. Because there is no tag bar at the lower end of the stator, the tools can pass completely through the stator.

DETAILED DESCRIPTION OF THE PREFERRED EMBODIMENT

Figure 1:
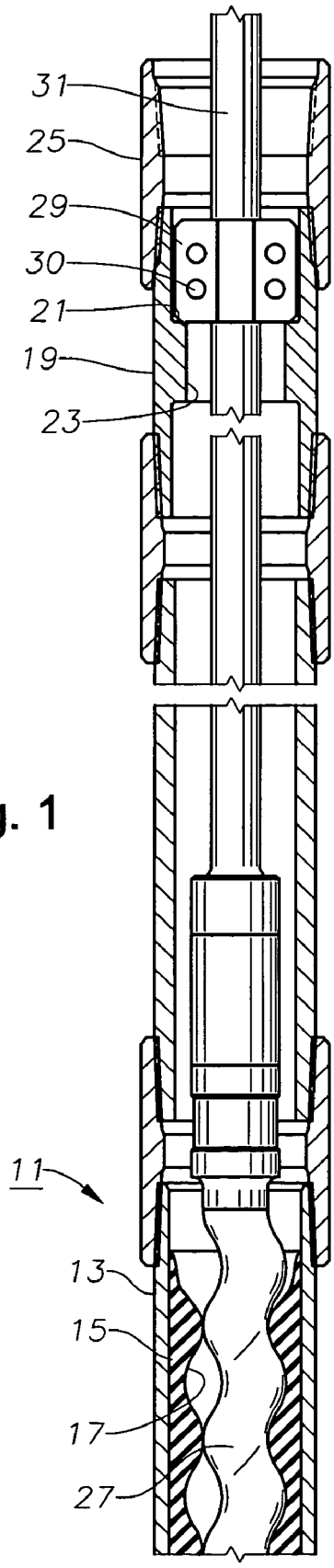
FIG. 1 is a vertical cross-sectional view of a portion of a pump assembly constructed in accordance with this invention, and shown with the stop landed on the tag shoulder.

Referring to FIG. 1, progressing cavity pump 11 has a stator 15 that is fixed within a housing 13. Housing 13, which may be considered a part of stator 15, is normally of metal while stator 15 is normally of a deformable elastomeric material. A helical passage 17 configured in a double helix extends through stator 15 in a manner that is conventional to progressing cavity pumps. Pump 11 is suspended on the end of a string of production tubing 25.

A sub 19 is mounted within tubing string 25 above stator housing 13. Sub 19 has a passage 23 containing a tag shoulder 21. In this embodiment, tag shoulder 21 is annular and faces upward. The inner diameter of passage 23 at tag shoulder 21 is equal to or slightly greater than the minimum inner diameter of passage 17 of stator 15. Tag shoulder 21 is shown as a flat surface that is perpendicular to the longitudinal axis of stator 15, but it could be conical, if desired. Passage 23 optionally may have an outward flared portion below tag shoulder 21.

Sub 19 is secured by threads into the string of tubing 25, and may be considered a part of the string of tubing 25. Tubing 25 is conventional and may be either a plurality of individual sections of pipe screwed together or continuous coiled tubing. The inner diameter of tubing string 25 is greater than the inner diameter of passage 23 at shoulder 21. By way of example, the inner diameter of tubing 25 might be 2⅞" while the inner diameter of passage 23 at shoulder 21 is 2½". The minimum inner diameter of passage 17 in a typical stator 15 for this use might be 1½".

A conventional rotor 27 is shown located within stator passage 17. Rotor 27 has a single helical configuration and is normally made of steel. A string of rods 31 extends downward from a drive motor (not shown) at the surface and connect to rotor 27 for rotating rotor 27. Rods 31 normally comprise individual solid steel members that have threaded ends for coupling to each other. The combination of rotor 27 and rods 31 define a drive string for pump 11.

A stop 29 is mounted to rods 31 above rotor 27 for movement therewith. Stop 29 may be two clamp halves, as shown, that are clamped around one of the rods 31 and secured by fasteners 30. Alternately, stop 29 could be secured in other manners, such as by threads, retainer rings, or welding. The distance from stop 29 to the lower end of rotor 27 is greater than the distance from the lower end of stator 15 to tag shoulder 21. When the lower end of rotor 27 is at the proper operational position in stator 15, which is with the lower ends of stator 15 and rotor 27 substantially flush, stop 29 will be located slightly above tag shoulder 21.

Stop 29 is preferably an annular enlargement having a greater outer diameter than rods 31, the upper end of rotor 27, and the inner diameter of passage 23 at tag shoulder 21. The outer diameter of stop 29 is less than the inner diameter of tubing 25. During operation, the upper end of rotor 27 orbits about the axis of stator passage 17, thus stop 29 will also orbit, and its outer diameter is sized accordingly.

In operation, the operator first secures stator housing 13 to a string of tubing 25 containing sub 21. The operator lowers the assembly into the well to a desired depth. Then, the operator assembles rotor 27 and stop 29 to a string of rods 31, making up a drive string. The operator lowers the drive string until stop 29 contacts tag shoulder 21, as shown in FIG. 1. The operator will know when this occurs because the weight indicator on the workover rig at the surface will display a weight drop off. At this point, a lower portion of rotor 27 will be protruding below the lower end of stator 15.

Figure 2:
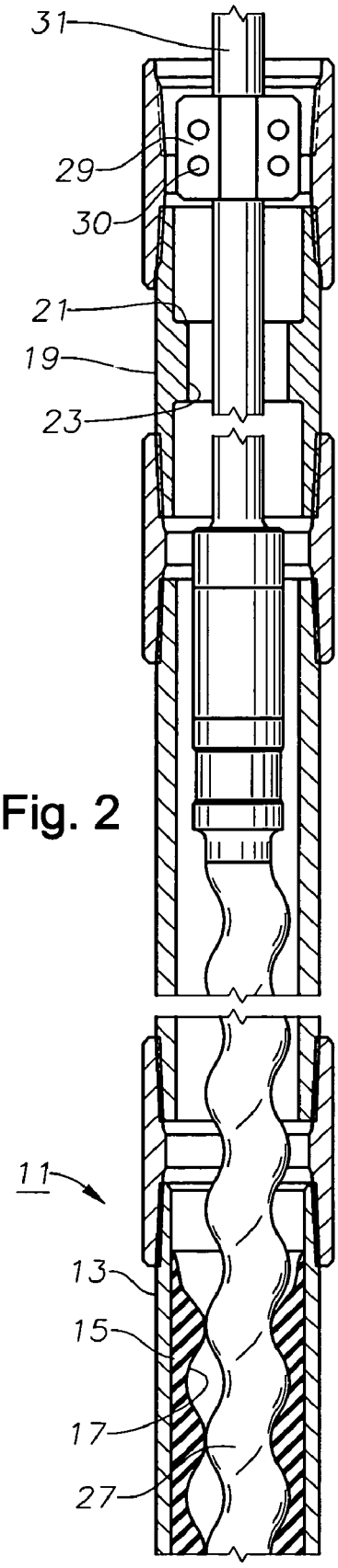
FIG. 2 is a view of the pump assembly of FIG. 1, showing the operator lifting the string of rods and rotor a selected amount after tagging the shoulder and before beginning operation of the pump.

The operator will normally have previously calculated an expected amount of stretch that will occur in the string of rods 31 during pumping operation, or he may do so at this time. The stretch is due to the weight of the fluid in the tubing 25 acting downward on pump rotor 27. The operator will pull the string of rods 31 upward an amount that is slightly greater than the expected amount of stretch to be assured that stop 29 does not contact tag shoulder 21 during operation. FIG. 2 illustrates rods 31 being pulled upward to accommodate stretch. At this point, the lower end of rotor 27 will be within passage 17 of stator 15 above the lower end of stator 15.

Once the desired elevation of rotor 27 has been reached, the operator couples the upper end of the string of rods 31 to the motor and drive assembly (not shown) at the surface of the well. The operator begins rotating rods 31 by the motor and drive assembly. Rotor 27 rotates within stator 15, pumping liquid to the surface. As tubing 25 fills with well fluid, rods 31 will stretch, causing rotor 27 to move downward relative to stator 15. Preferably, when rods 31 are fully stretched, the lower end of rotor 27 will be substantially flush with the open lower end of stator 15. This full engagement assures that pump 11 is able to pump at the desired capacity. When fully stretched, stop 29 will still be located a safe distance above tag shoulder 21.

By way of example, in a typical well, the operator might lift rods 31 an amount in the range from 12" to 24" after stop 29 lands on tag shoulder 21. The stretch during operation of a pump 11 in a well of typical depth would cause stop 29 to be normally above shoulder 21. The thrust on rods 31 due to the weight of column of well fluid is accommodated by thrust bearings at the motor and drive assembly at the surface.

Figure 3:
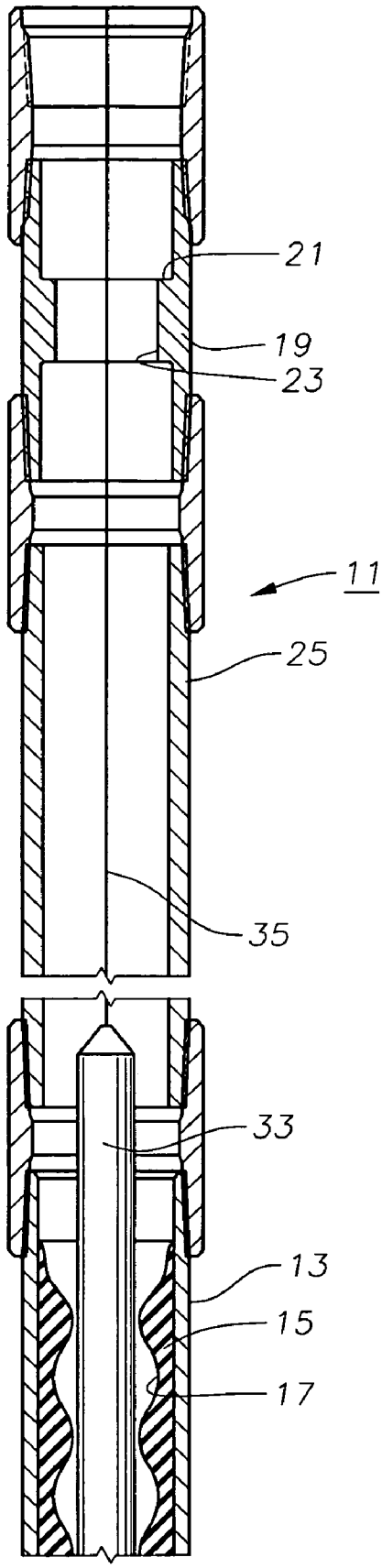
FIG. 3 is a view of the pump assembly of FIG. 1, with the rotor and rods removed and a wireline tool lowered through the stator.

If the operator wishes to perform wireline or small diameter coiled tubing operations below stator 15, he may do so by pulling rods 31 and rotor 27 to the surface. As shown in FIG. 3, the operator then lowers a tool or instrument 33 through tubing 25, preferably on wireline 35. The outer diameter of tool 33 is less than the minimum inner diameter of passage 17 in stator 15 and also less than the inner diameter of passage 23 at tag shoulder 21. Tool 33 thus will pass completely through stator 15 and out the open lower end. Tool 33 can be used for performing a wireline survey or logging operation, for determining the depth of fill that has occurred, or for other purposes.

The invention has significant advantages. The placement of a tag shoulder above the helical passage of the stator, rather than a bar below the stator, allows the operator to lower wireline tools below the stator. The tag shoulder allows a conventional tagging operation to occur much in the same manner as has been done with tag bars in the prior art.

While the invention has been shown in only one of its forms, it should be apparent to those skilled in the art that it is not so limited but susceptible to various changes without departing from the scope of the invention.

The invention claimed is:

1. A method of operating a progressing cavity well pump, comprising:

(a) providing a tag shoulder above a pump stator, securing the pump stator to a string of tubing and lowering the pump stator and tag shoulder into a well simultaneously with the string of tubing, the tag shoulder defining a restrictive passage to the stator that is more restrictive than a passage through the tubing to the tag shoulder;

(b) securing a pump rotor having a helical contour to a string of rods, defining a drive string, and providing a stop in the drive string;

c) after the tubing and the stator have been installed in the well, lowering the drive string and the pump rotor into the tubing until the pump rotor enters the stator and the stop lands on the tag shoulder; then (d) lifting the drive string a selected distance to place the stop above the tag shoulder, the selected distance being more than an expected stretch of the rods due to the weight of a full column of well fluid in the tubing; then (e) rotating the drive string, causing the rotor to rotate in the stator to pump well fluid up the tubing.

2. The method according to claim 1, further comprising:

retrieving the drive string from the tubing while the stator remains secured to the tubing; and lowering a tool through the tubing, past the tag shoulder, and through the stator.

3. The method according to claim 1, wherein step (a) comprises making the tag shoulder annular and providing the tag shoulder with an inner diameter smaller than an inner diameter of the tubing.

4. The method according to claim 1, wherein step (b) comprises making the stop annular with an outer diameter greater than an inner diameter of the tag shoulder.

5. The method according to claim 1, wherein after the tubing fills with well fluid in step (e), the stop is still spaced above the tag shoulder.

6. The method according to claim 1, wherein step (a) comprises making the tag shoulder annular and providing the tag shoulder with an inner diameter smaller than an inner diameter of the tubing and at least equal to a minimum inner diameter of the stator.

7. The method according to claim 1, wherein when the stop lands on the tag shoulder in step (c), the lower end of the rotor protrudes below the stator.

8. The method according to claim 1, further comprising: retrieving the drive string from the tubing while the stator remains secured to the tubing.

9. A method of operating a progressing cavity well pump, comprising:

(a) securing a pump stator to a lower end of a string of tubing and lowering the stator and the tubing simultaneously in a well, the pump stator having an elastomeric liner with a helical passage therethrough, and an annular tag shoulder above the helical passage of the stator that has an inner diameter less than an inner diameter of the tubing;

(b) securing a pump rotor to a string of rods to define a drive string, and providing an annular stop in the drive string that is a selected distance from a lower end of the rotor, the selected distance being greater than a distance from a lower end of the stator to the tag shoulder, the stop having an outer diameter greater than an outer diameter of the rods and greater than the inner diameter of the tag shoulder;

(c) after the tubing and the stator have been installed in the well, lowering the drive string and the pump rotor into the tubing until the rotor enters the stator and the stop lands on the tag shoulder; then (d) lifting the drive string a selected distance to place the stop above the tag shoulder, the selected distance being more than an expected stretch of the rods due to the weight of a full column of well fluid in the tubing; then (e) with the stop initially at the selected distance above the tag shoulder, rotating the drive string, causing the rotor to rotate in the stator to pump well fluid up the tubing, the well fluid in the tubing causing the rods to stretch and the rotor to move further downward in the stator.

10. The method according to claim 9, further comprising:

retrieving the drive string and the rotor from the tubing while leaving the stator at the lower end of the tubing; and lowering a tool through the tubing, past the tag shoulder, and through the stator.

11. The method according to claim 9, wherein the stop is still located above the tag shoulder in step (e) when the tubing is completely filled with well fluid.

12. The method according to claim 9, wherein after step (d) and before step (e), the lower end of the rotor is above the lower end of the stator.

13. The method according to claim 9, wherein when the stop lands on the tag shoulder in step (c), the lower end of the rotor protrudes below the stator.

14. The method according to claim 9, further comprising:

retrieving the drive string and the rotor from the tubing while leaving the stator at the lower end of the tubing.

15. A well pumping apparatus, comprising:

a string of tubing;

a progressing cavity pump stator securing to a lower end of the string of tubing, the stator having a helical passage therein, the stator having a housing with an outer diameter greater than an inner diameter of the string of tubing;

a tag shoulder mounted to the string of the tubing above the helical passage, the tag shoulder defining a restrictive passage that is more restrictive than the inner diameter of the string of tubing above the tag shoulder;

a string of rods that extends through the string of tubing;

a rotor secured to the string of rods for lowering the rotor through the string of tubing into the stator, the rotor and the string of rods defining a drive string, the string of rods and the rotor being retrievable from the stator while the stator remains secured to the lower end of the string of tubing; and a stop mounted to the drive string a selected distance from a lower end of the rotor, the stop being unable to pass downward past the tag shoulder, thereby providing an indication to an operator at the surface when the rotor enters the stator and the stop lands on the tag shoulder; and wherein the selected distance from the lower end of the rotor to the upper end of the stop is greater than a distance from a lower end of the stator to the tag shoulder so that the stop is located above the tag shoulder during operation of the pump.

16. The apparatus according to claim 15, wherein the tag shoulder is annular and has an inner diameter at least equal to a minimum inner diameter of the helical passage of the stator.

17. The apparatus according to claim 15, wherein the stop and the tag shoulder are annular, and the stop has an outer diameter greater than an inner diameter of the tag shoulder.

* * * * *